US008944290B2

(12) United States Patent
Schroeder

(10) Patent No.: US 8,944,290 B2
(45) Date of Patent: Feb. 3, 2015

(54) BEVERAGE DISPENSING SYSTEM HAVING A COLD PLATE AND RECIRCULATING PUMP

(75) Inventor: A. A. "Jud" Schroeder, San Antonio, TX (US)

(73) Assignee: Schroeder Industries, Inc., San Antonio, TX (US)

( * ) Notice: Subject to any disclaimer, the term of this patent is extended or adjusted under 35 U.S.C. 154(b) by 455 days.

(21) Appl. No.: 12/901,751

(22) Filed: Oct. 11, 2010

(65) Prior Publication Data

US 2011/0084096 A1 Apr. 14, 2011

Related U.S. Application Data

(60) Provisional application No. 61/250,717, filed on Oct. 12, 2009.

(51) Int. Cl.

| | |
|---|---|
| ***B67D 7/80*** | (2010.01) |
| ***B67D 1/08*** | (2006.01) |
| ***B67D 1/00*** | (2006.01) |

(52) U.S. Cl.

CPC ..... *B67D 1/0086* (2013.01); *B67D 2210/0006* (2013.01); *B67D 1/0862* (2013.01); *B67D 1/0054* (2013.01)

USPC ..... 222/146.6; 222/144.5; 222/131; 222/183

(58) Field of Classification Search

USPC ..... 222/144.5, 146.6, 143, 183, 222/129.1–129.4, 504, 145.6

See application file for complete search history.

(56) References Cited

U.S. PATENT DOCUMENTS

| | | | |
|---|---|---|---|
| 1,627,147 | A | 5/1927 | Clark |
| 1,947,329 | A | 2/1934 | Buttner |
| 2,478,586 | A | 8/1949 | Krapp |
| 2,682,386 | A | 6/1954 | Lindsay |
| 2,887,250 | A | 5/1959 | Zilk |
| 2,937,792 | A | 5/1960 | Firstenberg |
| 3,009,653 | A | 11/1961 | Hedeman |
| 3,013,701 | A | 12/1961 | Joschko |

(Continued)

FOREIGN PATENT DOCUMENTS

| | | |
|---|---|---|
| GB | 1 300 072 | 12/1972 |
| WO | WO 02/090241 | 11/2002 |

(Continued)

OTHER PUBLICATIONS

Wunder-Bar Food & Beverage Dispensing Systems, Post-Mix Beverage Dispenser, Automatic Bar Controls, Inc., Rev. 120508.

*Primary Examiner* — Paul R Durand
*Assistant Examiner* — Jeremy W Carroll
(74) *Attorney, Agent, or Firm* — Jackson Walker, LLP

(57) ABSTRACT

A recirculation loop for a beverage dispensing system. The beverage dispensing system has a fluid supply, a cold plate, a valve/manifold assembly, and a bar gun connected to the valve/manifold assembly. The recirculation loop draws off fluid being carried from the cold plate to the valve/manifold assembly and, having a pump as part thereof, pumps some of that fluid to a point just upstream of the cold plate. In this manner, the recirculation loop keeps fluid cool, even when the bar gun is not dispensing beverages therefrom, for long periods of time. That is, the pump runs independent of the bar gun and is typically on all the time, so that fluid in the line from the cold plate to the valve/manifold assembly stays chilled.

11 Claims, 2 Drawing Sheets

(56) References Cited

U.S. PATENT DOCUMENTS

| | | | | |
|---|---|---|---|---|
| 3,108,779 | A | 10/1963 | Anderson | |
| 3,326,520 | A | 6/1967 | Guenther | |
| 3,619,668 | A | 11/1971 | Pinckaers | |
| 3,643,754 | A | 2/1972 | Brandin et al. | |
| 3,867,962 | A | 2/1975 | Gerrard | |
| 3,963,317 | A | 6/1976 | Eigenbrode et al. | |
| 4,098,295 | A | 7/1978 | Haytayan | |
| 4,196,886 | A | 4/1980 | Murray | |
| 4,219,046 | A | 8/1980 | West et al. | |
| 4,390,224 | A | 6/1983 | Showman et al. | |
| 4,433,795 | A | 2/1984 | Maiefski et al. | |
| 4,469,389 | A | 9/1984 | Grabbe et al. | |
| 4,497,421 | A | 2/1985 | Schilling | |
| 4,519,635 | A | 5/1985 | McMath | |
| 4,619,378 | A | 10/1986 | de Man | |
| 4,635,824 | A | 1/1987 | Gaunt et al. | |
| 4,637,527 | A | 1/1987 | Arrigoni | |
| 4,821,921 | A | 4/1989 | Cartwright et al. | |
| 4,921,140 | A | 5/1990 | Belcham | |
| D309,232 | S | 7/1990 | Vallyee et al. | |
| 4,986,449 | A * | 1/1991 | Valiyee et al. | 222/144.5 |
| 5,033,648 | A | 7/1991 | Nakayama et al. | |
| 5,042,692 | A | 8/1991 | Vallyee et al. | |
| 5,190,188 | A * | 3/1993 | Credle, Jr. | 222/1 |
| 5,305,924 | A | 4/1994 | Groover et al. | |
| 5,524,452 | A | 6/1996 | Hassell et al. | |
| 5,649,431 | A | 7/1997 | Schroeder et al. | |
| 5,873,259 | A | 2/1999 | Spillman | |
| 6,112,946 | A | 9/2000 | Bennett et al. | |
| 6,196,422 | B1 | 3/2001 | Tuyls et al. | |
| 6,260,477 | B1 | 7/2001 | Tuyls et al. | |
| 6,269,973 | B1 | 8/2001 | Bennett et al. | |
| 6,283,155 | B1 | 9/2001 | Vu | |
| 6,322,051 | B1 | 11/2001 | Salmela | |
| 6,328,181 | B1 | 12/2001 | Schroeder et al. | |
| 6,405,897 | B1 | 6/2002 | Jepson et al. | |
| 6,463,753 | B1 | 10/2002 | Haskayne | |
| 6,626,005 | B2 | 9/2003 | Schroeder | |
| 6,644,508 | B2 | 11/2003 | Haskayne | |
| 6,672,849 | B1 | 1/2004 | Martindale et al. | |
| 6,698,229 | B2 | 3/2004 | Renken | |
| 6,722,527 | B1 | 4/2004 | Krauss | |
| 6,725,687 | B2 | 4/2004 | McCann et al. | |
| 6,761,036 | B2 | 7/2004 | Teague | |
| 6,832,487 | B1 | 12/2004 | Baker | |
| 6,945,070 | B1 | 9/2005 | Jablonski | |
| 7,025,230 | B1 | 4/2006 | Salmela | |
| 7,048,148 | B2 | 5/2006 | Roekens | |
| 7,080,937 | B1 | 7/2006 | Salmela et al. | |
| 7,232,044 | B1 | 6/2007 | Salmela | |
| D549,021 | S | 8/2007 | Tuyls et al. | |
| 7,266,974 | B2 | 9/2007 | Schroeder | |
| 7,305,847 | B2 | 12/2007 | Wolski | |
| 7,337,618 | B2 | 3/2008 | Wolski | |
| 7,337,627 | B2 | 3/2008 | Wolski | |
| 7,373,784 | B2 | 5/2008 | Haskayne | |
| 7,384,073 | B1 | 6/2008 | Tuyls et al. | |
| 7,448,418 | B1 | 11/2008 | Tuyls | |
| 7,762,431 | B1 | 7/2010 | Tuyls et al. | |
| D626,373 | S | 11/2010 | Valiyee et al. | |
| D626,374 | S | 11/2010 | Valiyee et al. | |
| D626,375 | S | 11/2010 | Valiyee et al. | |
| D628,014 | S | 11/2010 | Martindale | |
| 7,931,382 | B2 | 4/2011 | Hecht | |
| D638,659 | S | 5/2011 | Martindale et al. | |
| D643,708 | S | 8/2011 | Hecht | |
| D647,785 | S | 11/2011 | Hecht | |
| D648,420 | S | 11/2011 | Hecht | |
| D648,421 | S | 11/2011 | Hecht | |
| D648,617 | S | 11/2011 | Hecht | |
| D648,826 | S | 11/2011 | Hecht | |
| 2001/0030308 | A1 | 10/2001 | Schroeder | |
| 2003/0071060 | A1 | 4/2003 | Haskayne | |
| 2006/0162370 | A1 | 7/2006 | Haskayne | |
| 2006/0245956 | A1 * | 11/2006 | Lacroix et al. | 417/423.1 |
| 2008/0135426 | A1 | 6/2008 | Hecht et al. | |
| 2008/0217357 | A1 | 9/2008 | Hecht | |
| 2009/0078722 | A1 | 3/2009 | Salmela | |
| 2009/0090747 | A1 | 4/2009 | Tuyls et al. | |
| 2009/0145927 | A1 | 6/2009 | Salmela et al. | |
| 2009/0230148 | A1 | 9/2009 | Valiyee et al. | |
| 2010/0097881 | A1 | 4/2010 | Tuyls et al. | |
| 2010/0116842 | A1 | 5/2010 | Hecht et al. | |
| 2010/0147886 | A1 | 6/2010 | Martindale | |
| 2010/0314411 | A1 | 12/2010 | Tuyls et al. | |
| 2011/0057134 | A1 | 3/2011 | Martindale et al. | |
| 2011/0073617 | A1 | 3/2011 | Martindale et al. | |
| 2011/0286883 | A1 | 11/2011 | Hecht et al. | |
| 2011/0315711 | A1 | 12/2011 | Hecht et al. | |

FOREIGN PATENT DOCUMENTS

| | | |
|---|---|---|
| WO | WO 03/024862 | 3/2003 |
| WO | WO 2006/088990 | 8/2006 |
| WO | WO 2009/090429 | 7/2009 |

* cited by examiner

BEVERAGE DISPENSING SYSTEM HAVING A COLD PLATE AND RECIRCULATING PUMP

This application claims the benefit and incorporates herein by reference U.S. Provisional Patent Application Ser. No. 61/250,717, filed Oct. 12, 2009.

FIELD OF THE INVENTION

Beverage dispensing systems, more particularly, a beverage dispensing system having a cold plate and a recirculation pump.

BACKGROUND OF THE INVENTION

Beverage dispensing systems provide for the dispensing of a pre-selected beverage from a multiplicity of available beverages either through a bar gun, for example, or a beverage dispensing tower. It is important to dispense a cool or chilled beverage. It is especially important to maintain, to the extent reasonably possible, the soda water (carbonated water) at a cool or chilled temperature. The solubility of carbon dioxide in water is a function of temperature. The warmer the water, the less soluble the carbon dioxide.

One method of maintaining fluids to a beverage dispenser in a chilled or cool state is to run the fluids (syrup, water, and/or soda water) through a cold plate, which cold plate is typically located in the base of an ice chest. Typically, beneath a bar or adjacent to a bar will be one or more chests filled with ice. In the ice chests are the cold plates. The cold plates have multiple inlet ports and multiple outlet ports. The inlet ports receive syrup, water, and/or soda water from a multiplicity of sources. The fluids run through the cold plate and out the outlet ports. From the outlet ports, the fluids are carried typically to one or more manifold/bar guns or to the dispensing system. The cold plate outlet lines will carry the cooled fluid and are typically insulated. Typically, when a beverage is being dispensed, carbonated water will be carried through the cold plate and out the beverage dispenser in a chilled form.

However, if there is a sufficient period of time between dispensing actions, the fluid, including carbonated water in the lines upstream of the dispensing gun or dispensing nozzle and downstream from the cold plate, may warm up. In a subsequent dispensing, after a sustained period of time, this warm carbonated water or soda will tend to foam more than if it were cooler. Thus, it is preferable to maintain the fluids, especially the carbonated water (soda) that are chilled to a sub-ambient temperature to the extent possible.

OBJECT OF THE INVENTION

It is an object of the present invention to provide an apparatus to help maintain fluid in a dispensing system at a chilled temperature.

SUMMARY OF THE INVENTION

Applicant provides a recirculation loop, either retrofitable to existing beverage dispensing systems or built in from new, which recirculation loop provides for the recirculation of carbonated water from just upstream of a valve and manifold assembly to the inlet port at the cold plate.

Applicant provides an assembly for chilling dispensed fluids, the assembly comprising a fluid supply; a cold plate having a multiplicity of inlet ports and a multiplicity of corresponding fluidly connected outlet ports, the multiplicity of inlet ports including a first inlet port and the multiplicity of outlet ports including a first outlet port, the first inlet port and the first outlet port fluidly engaged; a fluid supply line for providing fluid from the fluid supply to the first inlet port of the cold plate; a valve/manifold assembly having inlet ports and outlet ports, the multiplicity of inlet ports including a first inlet port and the multiplicity of outlet ports including a first outlet port, the first inlet and first outlet ports fluidly engaged; a cold plate to valve/manifold assembly fluid line; a bar gun having a dispensing opening; a python connecting the valve/manifold assembly to the bar gun; and a recirculation loop engaging the fluid supply line and the cold plate to valve/manifold assembly fluid line for circulating fluid from the first inlet port of the valve/manifold assembly to the first inlet port of the cold plate, wherein the recirculation loop includes a valve assembly upstream of the first inlet port of the cold plate to receive fluid from upstream of the first inlet port of the valve/manifold assembly and from the fluid supply; wherein the recirculation loop includes a pump with an in line and an out line, the in line engaging the cold plate to valve/manifold assembly fluid line and the out line engaging the fluid supply line; wherein the recirculation loop includes a bypass fitting in the cold plate to valve/manifold assembly fluid line; wherein the recirculation loop includes a pump between the first inlet port of the valve/manifold assembly and the first inlet port of the cold plate and wherein the pump is a brushless pump/motor combination having a magnetic impeller; wherein the recirculation loop includes a pump with an in line and an out line, the in line engaging the cold plate to valve/manifold assembly fluid line and the out line engaging the fluid supply line; wherein the recirculation loop includes a valve assembly to receive fluid from the out line and the fluid supply line; and wherein the recirculation loop includes a bypass fitting in the cold plate to valve/manifold assembly fluid line; further including a second valve/manifold assembly; a second bar gun; a second python; and a second recirculation loop for engaging the first recirculation loop; further including a valve assembly in the fluid supply line adapted to provide for fluid to flow from the supply line into the first inlet port of the cold plate and from the cold plate to valve/manifold assembly into the first inlet port of the cold plate, and wherein the recirculation loop includes lines with insulation thereon; further including a carbonator engaging the fluid supply to carbonate the fluid being carried in the fluid supply line; wherein the recirculation loop includes lines with insulation thereon; wherein the recirculation loop includes a pump with an in line and an out line, the in line engaging the cold plate to valve/manifold assembly fluid line and the out line engaging the fluid supply line; wherein the recirculation loop includes a valve assembly to receive fluid from the out line and the fluid supply line; wherein the recirculation loop includes a bypass fitting in the cold plate to valve/manifold assembly fluid line; and further including a carbonator engaging the fluid supply to carbonate the fluid being carried in the fluid supply line.

DETAILED DESCRIPTION OF THE PREFERRED EMBODIMENT

Figures 1, 2:
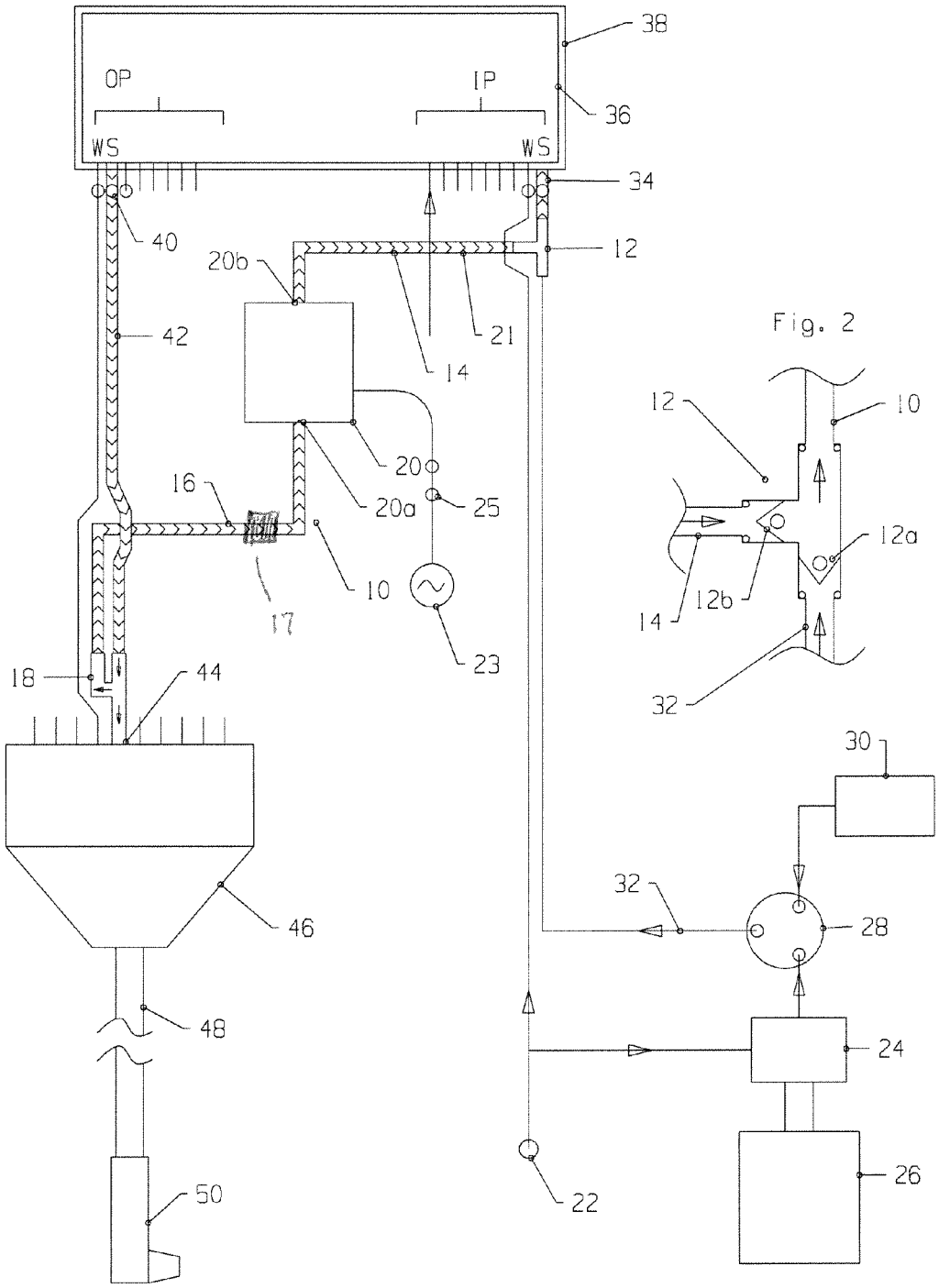
FIG. 1. is a drawing of the recirculation loop in a beverage dispensing system.
FIG. 2 is an illustration of a valve assembly for use with the recirculation pump.

FIG. 1 provides an illustration of the structure and function of Applicant's recirculation loop 10 in the environment in which it is used, here with a cold plate 36 as known in the art, which typically lies at the base or bottom of an ice chest 38. A dispensing system, here comprising a valve/manifold assembly 46 having a python 48 and a bar gun 50 at the removed end thereof, is illustrated. As known in the art, valve/manifold assembly 46 has a multiplicity of inlet ports at the upstream end thereof, here including a first inlet port which may be a cold $CO_2$ (carbonated water) inlet port 44.

Cold plate 36 or other cooling system typically has a multiplicity of inlet ports "IP" for receiving fluids, for example, syrup, plain water, and/or soda therein, which multiplicity of inlet ports include a first inlet port 34, which may be adapted to receive carbonated water from a carbonated water line or fluid supply line 32. Carbonated water is typically provided from a carbonation tank 28, which may receive a supply of $CO_2$ gas from a compressed gas supply 30 and receives water, here, for example, city water from a fluid supply 22, to a pump 24 driven by a motor 26. These elements are known in the art. That is to say, it is known in the art to provide carbonated water through a carbonation tank $CO_2$ source, pump and city water (or other water supply) into a cold plate 36. The multiplicity of outlet ports "OP" from the cold plate 36 typically include a soda water outlet port or first outlet port 40 in fluid communication with first inlet port 34; that is, an outlet port carrying soda water chilled by passage through the cold plate. A cold $CO_2$ line 42 or cold plate to valve/manifold assembly line is typically engaged to first outlet port 40 of the cold plate and is provided to supply chilled carbonated water to a dispensing system or a portion thereof, here, for example, to a valve/manifold assembly 46.

Turning now to FIG. 1, it is seen that Applicant provides a recirculation pump 20, such as a LAING™ brand pump Series E1 brushless (electronically commutated AC/DC/AC spherical motor centrifugal pump) pump/motor combination featuring a magnetic impeller or any other suitable pump. Recirculation pump 20 has an inlet port 20*a* for receiving a fluid therein and outlet 20*b* for providing a fluid at an increased pressure. This unit also features a screw off casing for removal of the casing from the inlet and outlet ports does not require removal of the lines from the ports at the pump—i.e., the casing of the motor/pump assembly, along with the motor, pump and impeller may be removed from the recirculation loop without touching or removing elements 20*a*/20*b*.

Applicant's recirculation loop 10 draws a fluid, typically soda water, from a bypass fitting 18 provided just upstream of soda water inlet port or first inlet port 44 for recirculation of the fluid through branch 16 (pump in line) to the inlet port 20*a* of the pump. Recirculation pump 20 carries the recirculated fluid to outlet port 20*b*, which carries the chilled fluid, herein sometimes described as recirculated fluid in line 14 (pump out line), to valve assembly 12 for recirculation through cold plate 36. Valve 12 assembly is typically just upstream of inlet port 34. Recirculation pump 20 is typically energized by an AC power source 23 and typically is left on at all times. A shutoff switch 25 may be provided if it is necessary to turn off energy to pump 20. That is to say, recirculation pump 20 is running even when the establishment is closed down or even between long periods of time when the bar gun 50 or other dispenser is not in use. Thus, recirculation fluid, typically soda water, is continually recirculating through the cold plate 36 and maintaining a chilled temperature. Typically, a recirculation flow of ¼-½ oz. per second may by use of (optionally) a flow control valve (for example, fixed or adjustably orifice) or restrictor 21 be located in the recirculation loop 10.

Turning now to elements of Applicant's valve assembly 12, one embodiment of Applicant's valve assembly includes a pair of check valves, here first check valve 12*a* and second check valve 12*b*. Check valve 12*a* is provided to provide the one-way flow of fluid, typically carbonated water, from carbonated water line or fluid supply line 32 into the valve assembly 12 and second check valve 12*b* is typically provided to receive fluid from branch or pump outline 14. Fluid will leave valve assembly 12 and enter first inlet port 34.

When there is no active dispensing, flow of the carbonated water is through the recirculation loop and is maintained at a chilled temperature. When carbonated water is being dispensed as, for example, from bar gun 50, there is a pressure drop in the system that allows circulation of the carbonated water from carbonated water line or fluid supply line 32 down to valve assembly 12 and into inlet port 34.

Figure 3:
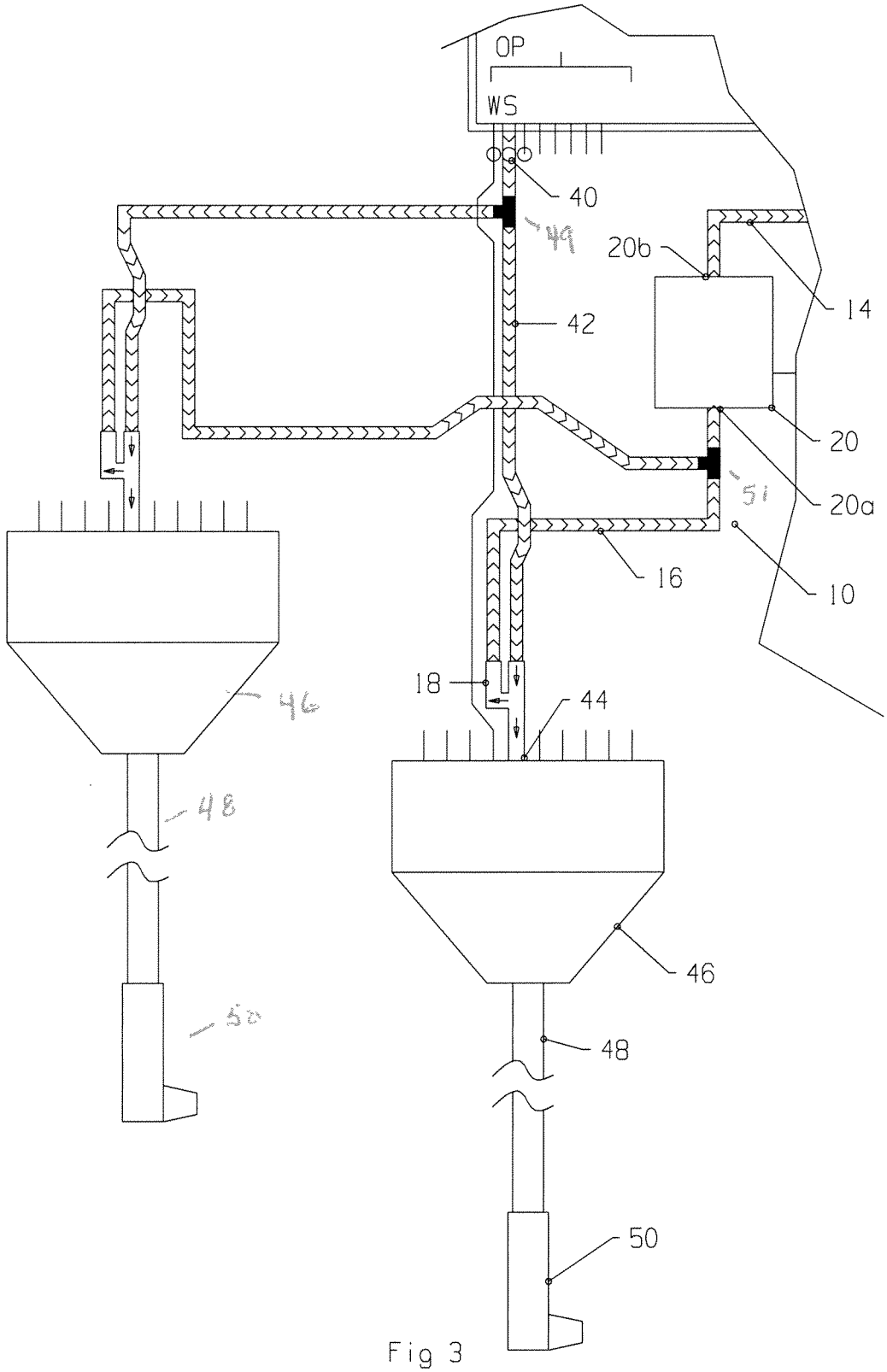
FIG. 3 illustrates a recirculation loop used with a second valve and manifold assembly and bar gun.

One or more bar guns may operate off a single cold plate, each bar gun having its own valve assembly and other optional or required elements of a single recirculation loop (see FIG. 3). When more than one bar gun/valve and manifold assembly is used, T junctions 49 and 51 may be used as illustrated for cooling the lines to the second valve and manifold assembly. Moreover, the term "cold plate" is used here to mean any known structure functioning to cool fluid supply lines from a fluid source.

Insulation 17, such as ARMAFLEX™ brand insulation or insulated foam tape may e; used on one or more of any of the lines of the recirculation loop.

A retrofit kit may be supplied to retrofit the existing system, which includes a pump, tubing, a flow control device (optional), check valve assembly, and splitter or bypass fitting 18.

Although the invention has been described in connection with the preferred embodiment, it is not intended to limit the invention's particular form set forth, but on the contrary, it is intended to cover such alterations, modifications, and equivalences that may be included in the spirit and scope of the invention as defined by the appended claims.

The invention claimed is:

1. An assembly for chilling dispensed fluids, the assembly comprising:

a fluid supply;

a cold plate having a multiplicity of inlet ports and a multiplicity of corresponding fluidly connected outlet ports, the multiplicity of inlet ports including a first inlet port and the multiplicity of outlet ports including a first outlet port, the first inlet port and the first outlet port fluidly engaged;

a fluid supply line for providing fluid from the fluid supply to the first inlet port of the cold plate;

a valve/manifold assembly having inlet ports and outlet ports, the multiplicity of inlet ports including a first inlet port and the multiplicity of outlet ports including a first outlet port, the first inlet and first outlet ports fluidly engaged;

a cold plate to valve/manifold assembly fluid line;

a bar gun having a beverage dispensing opening, the bar gun spaced apart from the valve/manifold assembly;

a python connecting the valve/manifold assembly to the spaced apart bar gun; and a recirculation loop engaging the fluid supply line and the cold plate to valve/manifold assembly fluid line for circulating fluid from near the first inlet port of the valve/manifold assembly to the first inlet port of the cold plate;

wherein the recirculation loop includes a pump/motor combination between the first inlet port of the valve/manifold assembly and the first inlet port of the cold plate; and wherein the recirculation loop includes a valve assembly located in the fluid supply line between the fluid supply and the cold plate and adapted to receive fluid from the cold plate to valve/manifold assembly fluid line and from the fluid supply.

2. The assembly of claim 1, wherein the recirculation loop includes a pump with an in line and an out line, the in line engaging the cold plate to valve/manifold assembly fluid line and the out line engaging the pump/motor combination to the valve assembly.

3. The assembly of claim 1, wherein the recirculation loop includes a bypass fitting in the cold plate to valve/manifold assembly fluid line.

4. The assembly of claim 1, further including a second valve/manifold assembly fluidly coupled to the cold plate by a second cold plate to valve/manifold assembly fluid line; a second bar gun; a second python fluidly coupling the second valve/manifold assembly and the second bar gun; and a second recirculation loop for engaging the cold plate to valve/manifold assembly fluid line and the first recirculation loop.

5. The assembly of claim 1, further including a carbonator engaging the fluid supply to carbonate the fluid being carried in the fluid supply line.

6. The assembly of claim 1, wherein the recirculation loop includes lines with insulation thereon.

7. The assembly of claim 1, wherein the valve assembly includes at least one check valve.

8. The assembly of claim 1, wherein the pump/motor combination of the recirculation loop is brushless and includes a magnetic impeller.

9. The assembly of claim 1, wherein the pump/motor combination of the recirculation loop provides a flow rate of about ¼-½ oz. per second.

10. The assembly of claim 1, wherein the valve assembly is adjacent one of the inlet ports of the cold plate.

11. The assembly of claim 1, wherein the recirculation loop includes a restrictor.

* * * * *